US005114823A

United States Patent [19]

Tomura et al.

[11] Patent Number: 5,114,823

[45] Date of Patent: May 19, 1992

[54] DEVELOPING METHOD FOR ELECTROSTATIC IMAGES

[75] Inventors: Shinya Tomura, Yamato; Mitsuaki Kohyama, Tokyo, both of Japan

[73] Assignee: Kabushiki Kaisha Toshiba, Kawasaki, Japan

[21] Appl. No.: 561,265

[22] Filed: Jul. 23, 1990

Related U.S. Application Data

[63] Continuation of Ser. No. 159,340, Feb. 23, 1988, abandoned.

[30] Foreign Application Priority Data

Feb. 25, 1987 [JP] Japan ..... 62-41631

[51] Int. Cl.[5] ..... G03G 13/08

[52] U.S. Cl. ..... 430/120; 430/111

[58] Field of Search ..... 430/107, 106.6, 97, 430/122, 120, 111

[56] References Cited

U.S. PATENT DOCUMENTS

| | | | |
|---|---|---|---|
| 2,638,416 | 5/1953 | Walkup et al. | 430/109 |
| 2,895,847 | 7/1959 | Mayo | 117/17.5 |
| 3,152,012 | 10/1964 | Schaffert | 118/637 |
| 3,731,146 | 5/1973 | Bettiga et al. | 317/3 |
| 4,342,822 | 8/1982 | Hosono et al. | 430/97 |
| 4,514,485 | 4/1985 | Ushiyama et al. | 430/107 |
| 4,628,860 | 12/1986 | Hosoya et al. | 118/649 |
| 4,656,965 | 4/1987 | Hosoya et al. | 118/649 |

FOREIGN PATENT DOCUMENTS 0241160 10/1987 European Pat. Off. .

OTHER PUBLICATIONS

IEEE-IAS-1985 Annual Meeting; "Xerographic Development Using Single-Component Non-Magnetic Toner"; M. Hosoya et al.

Patent Abstracts of Japan, JP-A-58 60 754, Apr. 11, 1983.

Patent Abstracts of Japan, JP-A-60 131 551, Jul. 13, 1985.

Patent Abstracts of Japan, JP-A-54 111 353, Aug. 31, 1979.

*Primary Examiner*—John Goodrow

*Attorney, Agent, or Firm*—Foley & Lardner

[57] ABSTRACT

This invention relates to a developing method which comprises forming a developing agent layer on the surface of a developing agent-carrying body by pressing a developing agent to the developing-agent carrying body by means of a coating member, and electrostatically depositing toner particles from the developing agent layer onto an electrostatic latent image formed on an image-bearing body which faces the developing agent layer. The developing agent contains toner particles including a synthetic resin with a glass transition point of 50° C. or above and a softening point of 110° to 116° C. and white or colorless auxiliary particles, said auxiliary particles being capable of being oppositely charged with respect to the polarity of the charge on the charged toner particles or charged to a lower positive potential than the positively charged toner particles or charged to a higher negative potential than the negatively charged toner particles.

21 Claims, 1 Drawing Sheet

DEVELOPING METHOD FOR ELECTROSTATIC IMAGES

This application is a continuation, of application Ser. No. 07/159,340, filed Feb. 23, 1988 now abandoned.

BACKGROUND OF THE INVENTION

1. Field of the Invention

This invention relates to a developing method and more specifically to a developing method for use in an electrophotographing apparatus or an electrostatic recording apparatus, in which a developing agent is deposited on an electrostatic latent image formed on a photoreceptor or a dielectric body to visualize the image.

2. Description of the Related Art Including Information Disclosed Under §§ 1.97–1.99

In electrophotographing apparatuses and electrostatic recording apparatuses, there has been widely employed, as a developing method providing a good-quality image, a developing method which uses a two-component developing agent consisting of a toner and a carrier to visualize the electrostatic latent image formed on an electrostatic image bearing body such as a photoreceptor or a dielectric body.

This developing method, however, has the following drawbacks.

(1) The toner is charged by mutual friction with the carrier. However, if used for long periods of time, the carrier surface will be contaminated by the toner and the toner will become unable to receive a sufficient amount of charge.

(2) To obtain a desired developing agent, it is necessary to control the mixing ratio of toner and carrier to stay in a specified range. If a developing agent is used for a long time, however, the toner/ carrier mixing ratio deviates from a specified range, making good developing impossible.

(3) Generally, hard particles such as iron powder, the surfaces of the particles of which are oxidized and glass beads are widely used as a carrier. Consequently, the surface of a photoreceptor suffers mechanical damage by the carrier, resulting in the life of the photoreceptor being shortened.

To overcome the problems stated above, various developing methods have been proposed that use a one-component developing agent consisting only of a toner without containing a carrier. Above all, there have been proposed many developing methods that use a magnetic toner containing magnetic powder.

However, the developing methods that use magnetic powder have the disadvantages that follow.

(1) Since the resistivity of a magnetic toner is relatively low, it is difficult to electrostatically transfer a toner image obtained by developing onto a common paper. Particularly in a highly humid atmosphere, the toner cannot maintain a sufficient amount of charge and therefore, satisfactory transferring of the image cannot be performed.

(2) The toner generally contains a large quantity of a magnetic toner consisting of blackish magnetite. As a result, color toners other than those of dark colors cannot be obtained.

For the above-mentioned reasons, developing methods have recently been proposed that use a one-component developing agent which consists of a toner such as used in a two-component developing agent, does not contain magnetic powder, and thus has a high resistivity. Among the developing methods using a one-component developing agent of this type are those which are based on the touch-down method, impression method and jumping method that have been disclosed in U.S. Pat. Nos. 2,895,847 and 3,152,012 and Japanese Patent Publication Nos. 66-9475, 70-2877 and 79-3624.

If the toner used in a two-component developing agent is used as a toner which constitutes a one-component developing agent, this will give rise to problems as follows.

(1) The amount of charge of the toner given by friction with a toner-carrying body is insufficient. Generally, in a developing method using a one-component developing agent, the toner needs to be charged efficiently and in a very short time by friction with the toner-carrying body and obtain a sufficient amount of charge (about $-0.5$ to $-15$ $\mu c/g$ for a photoreceptor made of selenium, for example) to visualize an electrostatic latent image formed on the photoreceptor or dielectric body without physical contact between the toner-carrying body and the electrostatic latent image.

However, with one-component developing agents consisting of a toner used in the conventional two-component developing agents, a sufficient amount of charge cannot be obtained by friction with the toner-carrying agent. More specifically, in the conventional developing method using two-component developing agent, a sufficient time is spent for frictional electrification between the toner and the carrier. On the other hand, in developing methods using a one-component developing agent, the time for frictional electrification between the toner and the toner-carrying body is short, with the result that the amount of charge large enough to visualize the electrostatic image cannot be obtained.

(2) The surface of the toner-carrying body needs to be coated with a toner in a very thin and uniform layer. With the type of toner used in two-component developing agents, it is difficult to form such a thin layer.

With reference to FIG. 1, an example of the formation of a thin toner layer on the surface of toner-carrying body 1 will now be described. As shown in FIG. 1, elastic blade 2 is pressed to the surface of toner-carrying body 1 with a pressure of 20 to 500 g/cm. As a result, while transferred by the rotating toner-carrying body, the toner from toner-container 3 is deposited, by means of elastic blade 2 on the surface of the toner-carrying body in a very thin and uniform layer. Therefore, the toner is required to have sufficient fluidity and anticoagulating property.

The problem with the employment of a toner used in a two-component developing agent for a one-component developing agent is that the toner, if not sufficiently charged, coagulates into lamps as it is carried by revolution of toner-carrying body 1 and cannot be deposited properly on the surface of toner-carrying body 1.

If the pressure of elastic blade 2 is raised in order to increase the amount of charge, toner 4 is suddenly subjected to a high pressure where elastic blade 2 contacts toner-carrying body 1. The resulting frictional heat softens toner 4, which thus sticks to the surface of toner-carrying body 1 instead of being deposited in a thin and uniform layer. If the softening point is raised, the fixing temperature of the toner increases, often causing troubles when such a toner is used in an ordinary electrophotographic copying machine or printer.

As set forth above, by the conventional developing method using a one-component developing agent, the developing agent cannot be sufficiently charged frictionally nor can it be deposited in a thin and uniform layer on the surface of toner-carrying body 1. This results in a low density of the image or fogging, making it impossible to obtain a clear image.

SUMMARY OF THE INVENTION

The object of this invention is to provide a developing method which can produce a clear image with a high image density without the occurrence of fogging.

The developing method of this invention comprises forming a developing agent layer on the surface of a developing agent-carrying body by pressing a developing agent to the developing agent-carrying body by means of a coating member, and electrostatically depositing toner particles from the developing agent layer onto an electrostatic latent image formed on an image-bearing body which faces the developing agent layer.

The above-mentioned developing agent contains the toner particles including a synthetic resin with a glass transition point of 50° C. or above and a softening point of 110° to 160° C. and white or colorless auxiliary particles capable of being oppositely charged with respect to the polarity of charge on the toner particles. The auxiliary particles are not limited to those which are capable of being oppositely charged with respect to the polarity of charge on the toner particles. The auxiliary particles may be those which are capable of being charged with the same polarity as toner particles if they can be charged to a lower potential than positively-charged toner particles or to a higher potential than negatively-charged toner particles, that is to say, so long as they can be charged to a potential closer to zero potential than the potential of the toner particles.

The reason why the glass transition point of the synthetic resin included in the toner particles is specified at 50° C. or above and its softening point at 110° to 160° C. is as follows: if the glass transition point is below 50° C., the storage stability of the toner is reduced and if the softening point is below 110° C., the so-called "offset" that the toner melts and is deposited to a fixing roller occurs during fixing. If the softening point exceeds 160° C., fixing becomes difficult.

As has been described, auxiliary particles used in a developing method according to this invention are those which are capable of being oppositely charged with respect to the polarity of charge on the toner particles, those which are capable of being charged to a lower positive potential than positively-charged toner particles or those which are capable of being charged to a higher negative potential than negatively-charged toner particles. In other words, when the toner particles are charged by friction with the coating member, the auxiliary particles are oppositely charged with respect to the polarity of charge on the toner particles or charged with the same polarity as the toner particles but to a potential closer to zero potential than the toner particles. Therefore, the electrification of the toner is promoted and it is possible to have the toner firmly hold the charge.

When or before the developing agent is pressed to the developing agent-carrying body by the coating member, the toner particles are charged frictionally as they contact the auxiliary particles in the developing agent. Therefore, the toner particles can be charged more sufficiently and securely than when they are charged by friction only with the coating member.

When the electrostatic latent image formed on the image-bearing body is developed by the developing agent, the auxiliary particles, having a polarity or a potential as described above, are not attached to the latent image and therefore, only the toner particles selectively contribute to developing. Even if the auxiliary particles are attached to the latent image, they do not appear in the developed image because they are either white or transparent. By using the developing method according to the present invention, it is possible to obtain a clear image without the occurrence of fogging.

DETAILED DESCRIPTION OF THE PREFERRED EMBODIMENTS

Figure 1:
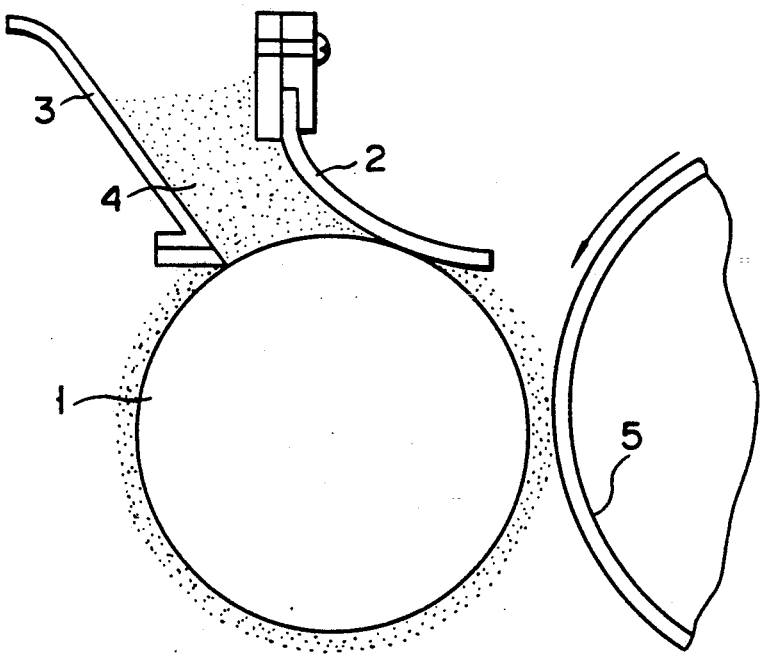
FIG. 1 is a sectional view of a developing apparatus to describe the conventional developing method.

This invention will now be described in greater detail in the following.

A developing agent used in the present invention comprises toner particles containing a specified synthetic resin and auxiliary particles capable of being charged with a specified polarity and a specified level of potential. The amount of auxiliary particles added to the toner particles should preferably be 0,05% to 10% by weight and more preferably 0.1% to 5% by weight. If the amount of the added auxiliary particles is less than 0.05% by weight, it is difficult to achieve a preliminary frictional charging effect between the toner particles and the auxiliary particles. If the added amount of the auxiliary particles exceeds 10% by weight, the concentration of the toner particles is decreased accordingly, thus reducing the image density.

The particle size of the auxiliary particles in terms of 50% weight average particle size should preferably be at most 1/5 of the toner particle size, and more preferably 1/200 to 1/10. If the auxiliary particles exceeds 1/5 the size of the toner particle size, the image density decreases. Normally, the particle size of the auxiliary particles is 2 μm or less.

To control charging of the toner, an charge controlling agent, such as metal complex dye, nigrosine series dye and polyamine series dye may be added to the toner. In addition, to improve the fluidity and the anticoagulating property of the toner, hydrophobic colloidal particles with the same polarity as the toner, such as colloidal silica, may be added with such a small quantity as not to affect the amount of charge of the toner.

For the resin contained in the toner particles, the following well-known materials may be used: styrene series copolymers including polystyrene, styrenebutadiene copolymer and styrene-crylic copolymer; etylene series copolymers including polyethylene, ethylene-vinyl acetate copolymer and thylene-vinyl alcohol copolymer; phenol series resin; polyamide series resin; polyester resin; maleic acid series resin; polymethyl methacrylate; polyacrylic acids; polyvinyl butyral; petroleum resin including aliphatic or cycloaliphatic hydrocarbon resin and aromatic hydrocarbon; chlorinated paraffin; low-molecular-weight polyethylene; wax; and mixtures of these materials.

The coloring agents used for toner particles are well-known coloring agents such as carbon black, fast yellow G, benzidine yellow, pigment yellow, indofast, orange, irgazine red, carmine FB, permanent borde FRR, pigment orange R, lithol red 2G, lake red C, rhodamine FB, rhodamine B lake, phthalocyanine blue, pigment blue, brilliant green B, phthalocyanine green and quinacridone.

The materials used for the auxiliary particles are well-known materials which are substantially white or colorless.

Among the materials used for the auxiliary particles are inorganic oxides such as aluminum oxide, titanium oxide, silicon oxide, zinc oxide, magnesium oxide, barium titanate, calcium titanate, calcium oxide, tin oxide and indium oxide; inorganic oxides surface-treated by a coupling agent such as a silane coupling agent or a titanium coupling agent, or by silicon oil; aliphatic or cycloaliphatic copolymers including stylene series copolymers such as polystyrene, polystyrol butadiene copolymer, styrene-acryl copolymer; aliphatic or cycloaliphatic copolymers such as polyetylene, ethyline series copolymer and polymethyl methacrylate; fine resin particles such as silicon resin and Teflon; and fine resin particles surface-treated by a coupling agent or silicon oil.

The practical examples of the inorganic oxide particles and the surface-treated inorganic oxide particles which are capable of being charged positively among the above-mentioned auxiliary particles are Oxide C, RX-C, RA-200, RA-200H, RP-130 (Nippon Aerasil), HDK, VP, KHD (Wakka), No. 205, No. 206, No. 207, MT-150A, MT-150B, MT-600B (Teikoku Kako) and SAZEX 4000 (Sakai Kagaku).

The concrete examples of the resin particles and surface-treated resin particles which are capable of being charged positively include MP-2701, MP-2032, V-2029, MP-2800, V-2035 (Soken Kagaku) and NJ-0401 (Nippon Paint).

The concrete examples of inorganic oxide particles and surface-treated inorganic oxide particles which are capable of being charged negatively are Aerosil R-972, R-974, R-805, R-812, T-805, P-25, P-130, MOX-170 (Nippon Aerosil), Sipernet D10, D17 (Degussa), No. 201, No. 202 and MT-150W (Teikoku Kako).

The concrete examples of resin particles and surface-treated resin particles which are capable of being charged negatively are MP-1000, MP-1100, MP-1220, MP-1401, MP-3100, SEP-4 (Soken Kagaku) and NT-0718 (Nippon Paint).

The measuring method of the amounts of charge of the toner particles and auxiliary particles is described in the following.

A sample of 3% by weight is mixed with iron oxide powder (TEF-V, 200/300: Teikoku Teppun) as the carrier and thus, sample A is prepared. 200 mg of sample A is put into a sample holder having a 400 mesh conductive net mounted thereon. This sample holder is mounted on a charge measuring instrument (blow-off TB-200: Toshiba Chemical). A $N_2$ gas blows the sample holder at a pressure of 1 kg/cm$^2$ for one minute and the amount of charge of sample A is measured. By dividing the obtained value of the charge by the weight (200 mg) of the sample A, the amount of the charge per unit weight is obtained.

Figure 2:
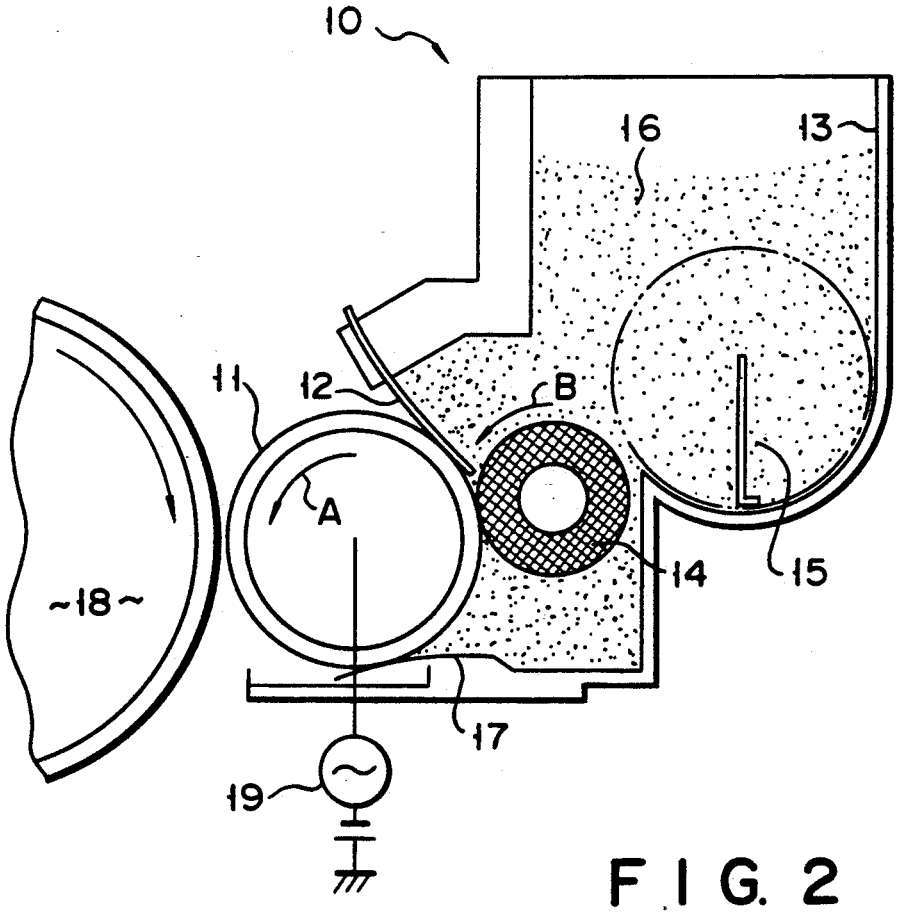
FIG. 2 is a sectional view of a developing apparatus for carrying out an embodiment of this invention.

With reference to FIG. 2, a developing apparatus used in the embodied examples of this invention will now be described in the following.

Referring to FIG. 2, the reference numeral 10 indicates the entire developing apparatus. Developing sleeve 11 as the developing agent-carrying body is pressed at a pressure of about 200 g/cm to about 500 g/cm on its circumferential surface with elastic blade 12 for forming a thin developing agent layer on the circumferential surface. In toner container 13, there is supply roll 14 for supplying developing agent 16 to developing sleeve 11, the supply roll being so arranged as to be in contact with developing sleeve 11 and rotate in the direction (arrow A) opposite to the rotating direction (arrow B) of the developing sleeve. Stirring blade 15 to stir developing agent 16 is also provided rotatably in toner container 16. Developing sleeve 11 has at its underside recovery blade 17 in contact therewith to recover the developing agent remaining on developing sleeve 11.

Developing sleeve 11 is connected with power supply 19 to apply a DC bias, a AC bias or a DC/AC superimposed bias.

The operation of developing apparatus 10 will now be described in the following. Developing agent 16 contained in container 13 is stirred by rotating stirring blade 15. In this step, the toner particles and auxiliary particles which constitute developing agent 16 frictionally contact with one another and are charged.

Developing agent 16 thus preliminarily charged is carried by supply roll 14 and spread over the surface of developing sleeve 11. The developing agent on the surface of the developing sleeve is controlled in its layer thickness and charged frictionally by the pressing with elastic blade 12. Developing agent 16 which has been charged sufficiently is carried to a position where it faces photoreceptor 18. An AC voltage is applied to developing sleeve and therefore, while repeating reciprocating motions in the directions of going away from and returning to developing sleeve 11, the developing agent comes to be attached to the electrostatic image formed on photoreceptor 18.

The toner particles and the auxiliary particles have mutually opposite charge polarities or the auxiliary particles have the same charge polarity as the toner particles but a potential closer to zero potential than the toner particles. Therefore, only the toner particles are attached electrostatically to the electrostatic latent image and visualize the image.

The developing agent remaining on developing sleeve 11 is collected by recovery blade 17 and returned to container 13.

EXAMPLE 1

A mixture comprising 93 parts by weight of styrene-n butyl methacrylate copolymer (glass transition point Tg=66° C.; average molecular weight MW=99,000; softening point=123° C.) as the resin material for toner particles, 4 parts by weight of carbon black (tradename MA-100: Mitsubishi Chemical) as the coloring agent and wax (tradename 660P: Sanyo Kasei) were kneaded by a pressure-type kneader for about one hour. Then, the mixture was cooled, crushed by a hammer mill and pulverized by a jet mill. The fine particles thus prepared were subjected to air classification and the toner particles were thus obtained. The 50% weight average particle size of the toner particles was 12,8 μm and the amount of charge measured by the above-described blow-off method was −28.5 μc/g.

On the other hand, silica (50% weighted average size=1.2 μm; charge amount=+310 μc/g), which had been surface-treated by γ-aminopropyl triethoxysilane, was used for the auxiliary particles.

One hundred parts by weight of the above-mentioned toner particles and one part by weight of the auxiliary particles were mixed by a V-type blender for one hour and a one-component developing agent was thus produced.

This developing agent was fed to the developing apparatus of FIG. 1. This developing apparatus was mounted on a copying machine (tradename 3110: Toshiba) equipped with an OPC which is negatively charged, and print copies of an original image were reproduced on papers.

Clear images with an image density of 1.35 without fogging were obtained. Using the same method, developing was performed in a high-temperature, high-humidity environment (temperature 30° C. and humidity 85%). Distinct images were obtained with high copying efficiency, which are free of fogging and with no reduction in image density. Referring to the image density, a density value of about 1.3 is about the same density of the original. If the value is lower than this, the image is higher than the original and if the value is higher than this, the image is darker.

When the images obtained were fixed by a heat roll fixing unit, excellent properties of fixing and offset were obtained in the range of 170° C. to 220° C. Even after copying 10,000 sheets, images with the same quality were obtained.

Control

When copy images were reproduced under the same conditions as in Example 1 by using a developing agent containing only the toner particles obtained in Example 1, that is to say, without containing auxiliary particles, the image density was 1,1 and fogging occurred frequently.

EXAMPLE 2

By the same procedure as in Example 1 except for the use of styrene-n-butyl methacrylate/2-ethyl-aminoethyl methacrylate copolymer (glass transition point Tg=67° C.; average molecular weight MW=280,000; softening point=135° C.) as the resin material for toner particles, toner particles (50% weight average particle size=13.1 μm; charge amount=32.8 μc/g) were obtained. Meanwhile, a one-component developing agent was produced in the same manner as in Example 1 by using polymethacrylate (average particle size=0.4 μm; charge amount=−500 μc/g) as the auxiliary particles. By using this developing agent, copying was performed to reproduce duplicate images of an original on sheets of paper.

The result was distinct images with a good image density and no fogging just as in Example 1.

EXAMPLE 3

By using the same materials for the toner particles as in Example 2 and titanium dioxide particles (average particle size=0.015 μm; charge amount=+8.0 μc/g) for the auxiliary particles, a one-component developing agent was produced in the same manner as in Example 1. By using this developing agent, copy images were formed in the same manner as in Example 1. As a result, distinct copy images with a good image density and without fogging could be obtained just like those obtained in Example 1.

EXAMPLE 4

A mixture consisting of 92 parts by weight of bisphenol type polyester resin (glass transition point Tg=78.5° C.; average molecular weight MW=32,000; softening point=135° C.) for the resin included in the toner particles, 4 part by weight of carbon black (Laben 3500: Columbia Carbon) for the coloring agent, 3 parts by weight of wax (660P: Sanyo Kasei) and 1 part by weight of charge controlling agent (E-82: Orient Chemical Co.) was subjected to the same processes as in Example 1 and thereby toner particles with a 50% weight average particle size of 11.8 μm and a charge amount of −32.5 μc/g were obtained.

By using the toner particles thus prepared and auxiliary particles consisting of styrene-methyl methacrylate resin (average particle size=0.2 μm; charge amount=+400 μc/g), a one-component developing agent was produced in the same manner as in Example 1.

By using this developing agent and the same developing method as in Example 1 except for the use of a copying machine (BD3110: Toshiba) equipped with a positively charged selenium drum, copy images were formed. The result is distinct copy images with a good image density and free of fogging.

EXAMPLE 5

By using the toner particles and the auxiliary particles consisting of titanium dioxide particles (average particle size=0.015 μm; charge amount=−20 μc/g), a one-component developing agent was obtained in the same manner as in Example 1.

Using this developing agent and the developing method as in Example 4, copy images were produced with good quality as in Example 4.

What is claimed is:

1. A developing method, comprising: forming a one-component developing agent layer on the surface of a developing agent-carrying body by pressing a one-component developing agent to the developing-agent carrying body by means of a coating member, said one-component developing agent containing toner particles including a synthetic resin and auxiliary particles capable of being oppositely charged with respect to the polarity of charge on the charge of the toner particles; and electrostatically depositing toner particles from the one-component developing agent layer onto an electrostatic latent image formed on an image-bearing body which faces the one-component developing agent layer.

2. The developing method according to claim 1, wherein said synthetic resin has a glass transition point of 50° C. or above and a softening point of 110° C. to 1600° C.

3. The developing method according to claim 1, wherein said auxiliary particles are substantially transparent.

4. The developing method according to claim 1, wherein the added amount of the auxiliary particles to the toner particles is 0.05% to 10% by weight.

5. The developing method according to claim 4, wherein the added amount of the auxiliary particles to the toner particles is 0.5% to 5% by weight.

6. The developing method according to claim 1, wherein the particle size of the auxiliary particles is, in terms of 50% weight average particle size, at most 1/5 the size of the toner particle size.

7. The developing method according to claim 5, wherein the particle size of the auxiliary particles is, in terms of 50% weight average particle size, 1/200 to 1/10 of the toner particle size.

8. The developing method according to claim 1, wherein the size of the auxiliary particles is 2 μm or less.

9. The developing method according to claim 1, wherein the auxiliary particles are made of at least one of the elements selected from the group consisting of inorganic oxide particles, surface-treated inorganic oxide particles, synthetic resin particles and surface-treated synthetic resin particles.

10. The developing method according to claim 1, wherein an AC bias is applied to said developing agent-carrying body, said one component developing agent being electrostatically attached to said electrostatic latent image as said developing agent moves alternately back and forth between said developing agent-carrying body and said image-bearing body.

11. A developing device, comprising: means for forming a one-component developing agent layer on the surface of a developing agent-carrying body by pressing a one-component developing agent to the developing-agent carrying body by means of a coating member, said one-component developing agent contains toner particles including a synthetic resin and auxiliary particles capable of being charged to a higher negative potential than the negatively charged toner particles; and means for electrostatically depositing toner particles from the one-component developing agent layer onto an electrostatic latent image formed on an image-bearing body which faces the one-component developing agent layer.

12. A developing method, comprising: forming a one-component developing agent layer on the surface of a developing agent-carrying body by pressing a one-component developing agent to the developing-agent carrying body by means of a coating member, said one-component agent containing toner particles including a synthetic resin with a glass transition point of 50° C. or above and a softening point of 110° to 160° C. and white or colorless auxiliary particles capable of being charged to a lower positive potential than the positively charged toner particles; and electrostatically depositing toner particles from the one-component developing agent layer onto an electrostatic latent image formed on an image-bearing body which faces the one-component developing agent layer.

13. The developing method according to claim 12, wherein the amount of the auxiliary particles added to the toner particles is 0.05% to 10% by weight.

14. The developing method according to claim 13, wherein the amount of the auxiliary particles added to the toner particles is 0.5% to 5% by weight.

15. The developing method according to claim 12, wherein the auxiliary particle size is, in terms of 50% weight integrated average particle size, at most 1/5 of the toner particle size.

16. The developing method according to claim 15, wherein the particle size of the auxiliary particles is, in terms of 50% weight integrated average particle size, 1/200 to 1/10 of the size of the toner particles.

17. The developing method according to claim 12, wherein the size of the auxiliary particles is 2 μm or less.

18. The developing method according to claim 12, wherein the auxiliary particles are made of at least one of the elements selected from the group consisting of: inorganic oxide particles, surface-treated inorganic oxide particles, synthetic resin particles and surface-treated synthetic resin particles.

19. The developing method according to claim 12, wherein an AC bias is applied to said developing agent-carrying body, said one component developing agent being electrostatically attached to said electrostatic latent image as said one component developing agent moves alternately back and forth between said developing agent-carrying body and said image-bearing body.

20. A developing method, comprising: forming a one-component developing agent layer on the surface of a developing agent-carrying body by pressing a one-component developing agent to the developing-agent carrying body by means of a coating member, said one-component developing agent containing toner particles including a synthetic resin with a glass transition point of 50° C. or above and a softening point of 110° to 160° C. and white or colorless auxiliary particles capable of being charged to a negative potential higher than the negatively charged toner particles; and electrostatically depositing toner particles from the one-component developing agent layer onto an electrostatic latent image formed on an image-bearing body which faces the one-component developing agent layer.

21. The developing method according to claim 1, wherein said toner particles are non-magnetic.

* * * * *